United States Patent [19]

Rundle

[11] Patent Number: 4,912,913

[45] Date of Patent: Apr. 3, 1990

[54] BAG SEALING MACHINE

[75] Inventor: Gregory E. Rundle, Richmond, Canada

[73] Assignee: Bemis Company, Inc., Minneapolis, Minn.

[21] Appl. No.: 283,721

[22] Filed: Dec. 13, 1988

Related U.S. Application Data

[62] Division of Ser. No. 103,652, Oct. 3, 1987, Pat. No. 4,813,207.

[51] Int. Cl.[4] ..... B65B 51/06; B65B 51/08

[52] U.S. Cl. ..... 53/583; 156/468

[58] Field of Search ..... 53/138 A, 583; 29/243.56, 243.57; 156/468

[56] References Cited

U.S. PATENT DOCUMENTS

| | | | |
|---|---|---|---|
| 1,551,525 | 8/1925 | Hamer . | |
| 2,867,066 | 1/1959 | Platt | 53/138 A |
| 2,867,067 | 1/1959 | Platt et al. | 53/198 |
| 2,916,863 | 12/1959 | Leighton | 53/583 X |
| 3,648,432 | 3/1972 | Zellmer | 53/135 |
| 3,729,896 | 5/1973 | Lehmann | 53/138 A |
| 3,783,585 | 1/1974 | Hoyland | 53/585 |
| 4,364,511 | 12/1982 | Wittern et al. | 229/63 |
| 4,545,185 | 10/1985 | Chikatani | 53/583 |
| 4,621,479 | 11/1986 | Hoyland | 53/133 |
| 4,721,545 | 1/1988 | Santorineos | 53/583 X |

FOREIGN PATENT DOCUMENTS 1517031 7/1978 United Kingdom .

*Primary Examiner*—John Sipos

*Attorney, Agent, or Firm*—Senniger, Powers, Leavitt and Roedel

[57] ABSTRACT

This invention is directed to a novel bag sealing machine. More particularly, this invention is directed to a novel machine which can be used for sealing and securing bags which are loaded and held in boxes. The bags in the boxes are loaded from the top with a designated product before the opening at the top of the bag is sealed by the machine. A bag sealing apparatus comprising: (a) conveyor means for conveying through the apparatus a loaded bag which has an opening at the top of the bag; (b) upwardly bag wall forcing means for forcing the open end of the bag upwardly into gripping means, said gripping means drawing the gripped portion of the bag together to accumulate the gripped portion of the bag into a neck-like portion; (c) bag side support means located downstream from the upwardly bag wall forcing means for supporting the side of the bag and drawing it in a downstream direction along the conveyor means; (d) neck accepting and accumulating means located downstream from the upwardly bag wall forcing means for accepting and accumulating the neck of the bag as formed by the gripping means upstream; and, (e) means for applying a fastening means about the circumference of the accumulated neck of the bag after it has been accepted by the neck accepting and accumulating means.

3 Claims, 9 Drawing Sheets

BAG SEALING MACHINE

This is a division, of application Ser. No. 103,652 filed Oct. 3, 1987 now U.S. Pat. No. 4,813,207.

FIELD OF THE INVENTION

This invention is directed to a novel bag sealing machine. More particularly, this invention is directed to a novel machine which can be used for sealing and securing bags which are loaded and held in boxes. The bags in the boxes are loaded from the top with a designated product before the opening at the top of the bag is sealed by the machine.

BACKGROUND OF THE INVENTION

Recently, partly due to economic circumstances, it has become customary to package and sell a designated product such as fertilizer granules, wall plastering materials, instant ready cement, and the like, in plastic bags which are contained within cardboard boxes. The advantage of this combination is that the boxes are relatively inexpensive and reinforce the bag against handling abuse so that the bag can be of a thinner gauge less expensive plastic material than would be the case if the bag with contents were sold without a protective box. The bag in a box combination is a direct inexpensive substitute for plastic pails.

A difficulty with using plastic bags in boxes is that a complex procedure is required to seal the neck of the bag after the product has been dispensed into the bag, and then tuck the gathered neck neatly into the box so that the flaps at the top of the box can be glued together. On a full shift basis, it is usually possible for a human-being to twist-tie six or seven bags per minute. Not only is this labour intensive work, but it is also mind-numbing. It would be advantageous if the bags could be sealed at a faster rate, for example, 30 bags per minute, which would be more in line with the package speeds of conventional packaging conveyor systems.

The applicant is aware of the following references or patents which teach or disclose potentially relevant apparatus and processes for sealing loaded bags.

U.S. Pat. No. 4,364,511 discloses a tube of film material that is used to enclose food. The tube has a closure tie with a suspension lop. The enclosure tie includes a knot lying in a recess in the pleated tip of the film. The recess in which the tie is located is formed by softening the tube by heating, for example, with warm air, IR radiation, ultrasonic means, by previously heating the tie filament, or by treating the film material with solvents or softening agents. Equipment is also described to perform the process.

West German Patent No. 28 16 310 PS discloses a device for tying-up open bags of similar objects.

European Patent No. 0,010,937 discloses an apparatus for knotting the mouths of flexible packaging materials.

European Patent No. 0 132 715-A2, Poetz, B., discloses a closure which has a degassing valve.

European Patent No. 0 045 775, Houlberg, J.P. discloses an injection moulded bag closure.

European Patent No. 0 009 987, Debenham, M. et al., discloses an easy opening closure with a resealable pressure releasing device.

Verpackungsberater (1983) No. 8,487 discloses a binding machine that can be used for widely differing applications. Reference is made to a pallet binder, pallet releasers (strapping cutters), tunnel binders, a collar binding machine, a binder for flowers and vegetables as well as a standard automatic Type P machine.

Food Flavourings, Ingredients, Processing and Packaging, 1985, 7, 2–11, discloses an apparatus for Tetra-Pak TM packaging that cuts blanks from a jumbo roll seals the bottom and side (by hot air), and fills the seals up to 6000 gable-top cartons/h before replenishment with a new roll from the incorporated magazine is necessary. RC 7 and RC 4 machines are on the market with roll feed attachment, and RC 7 R-machines are adjustable for gable- or slate-top cartons. Another Tetra Pak innovation is a pull-tap opening - a sealed pear-shaped punched hole, airtight until removal of a covering A 1 pull-tab, with a small plastic strip attached to the pouring edge, for its 25, 200 and 250 ml aseptic cartons.

Emballage Digest, 1984, No. 277, pages 184–188, discloses an impulse welding machine; new PE films, LDPE canisters with incorporated handles, injection moulding, MB 600 film for wrapping confectionary boxes; light plastics pallets; canisters for chemicals; a Cubitainer TM for liquids; an Akylux display package; shrink film machines; injection machines for producing plastics corks; packaging of liquids or pasty products in bags; and foam packaging.

Australian Packaging, 1984, 32, (4) 22 describes a new twist wrap material, namely Hiblon TM, an unaxially oriented polyethylene film based on the T-die extrusion method developed by Mitsui Toatsu Chemical Co. A table compares the properties of Hiblon with moisture proof cellulose and in particular the twist properties by a twist retention test. Special twist wrapping machinery has been developed to work at speeds of up to 1200 pieces/min. for hard sweets.

Emballage Digest, 1984, 26,(284), 119–121 discusses inviolable metal and plastic closures for barrels (Tri-Sure TM and Tab-Seal TM) and Sorfim TM cases - decorative presentation packaging for one or more luxury goods.

Verpackungs-Rundschau, 1984, 35, (11), 1536, 1537 discloses a method of injecting Plastisol TM onto polypropylene closures. The special sealing compound in the lid is heated in a continuous oven and then brought to the required temperature by microwave heaters. The plastic closure is not further heated at the same time. An extensive range of equipment achieves the desired levels of performance. Also described is a Daramelt TM system which enables other plastics, such as PE, to be used: These seals do not require any further treatment and the production of foamed seals is also possible. The process is also suitable for the packaging of food.

Emballage Digest, 1984, No. 276, 110, 112, 115, 116, 118, 120, 122–126 discloses automatic gluing of plastic pots; single material closure for mineral water; load securing with hotmelt; a new banding machine; machines for adhesive taping of boxes; hotmelt application systems; electric stapler and nailer; bands for retail packs; new closing joints with expanded PE and barrier films; welding of metal seams by polyamide hotmelts; and closing of cardboard packs.

Australian Packaging, 1983, 31, (11), 12 describes a new system of packing for the safe transportation of electronic apparatus, computers and precision instruments. The containers are lined with an inert, anti-static flexible foam cushioning material. An additional feature is the inclusion of a plastic locking device.

Emballage Digest, 1983, 25, (273), 24–30 discloses a plastic reclosable lid for cardboard packages containing instant drinks powder; PVC tear-resistant films for easy-to-open thermoformed packs; and biaxially-oriented hollow bodies.

Verpackungs-Rundschau, 1983, 34, (11), 1232–1233 describes a new type of PE for the production of packaging materials and packages: rigid, distortionfree, shock-resistant containers; large storage and transport containers; small transport cases and storage containers, and shock-resistant blown films for detergent containers.

Holz-Zentralblatt, 1984, No. 16,231 discloses flexible bands made of polyester resin which serve to secure pallet loads or bundles with trimmed timber and plates. For sealing the band is knotted, tensioned, tied or wedged.

Fixed spoked gear-wheel-like tape mechanisms are available on the marketplace and manufactured by companies such as 3M Corporation of Minneapolis, Minnesota.

SUMMARY OF THE INVENTION

The invention is directed to a bag sealing apparatus comprising: (a) means for conveying through the apparatus a loaded bag which has an opening at the top of the bag; (b) upwardly bag wall forcing means for forcing the open end of the bag upwardly into gripping means, said gripping means drawing the gripped portion of the bag together to accumulate the gripped portion of the bag into a neck-like portion; (c) bag side support means located downstream from the upwardly bag wall forcing means for supporting the side of the bag and drawing it in a downstream direction along the conveyor means; (d) neck accepting and accumulating means located downstream from the upwardly bag wall forcing means for accepting and accumulating the neck of the bag as formed by the gripping means upstream; and, (e) means for applying a fastening means about the circumference of the accumulated neck of the bag after it has been accepted by the neck accepting and accumulating means.

In the apparatus, the bag may have a cuff (the top is folded down) and the bag may be located in the interior of a box which is open at the top. The upright bag uncuffing means may be at least one airjet which blows the cuff of the bag upwardly into the cuff gripping means. The cuff gripping means are at least one pincer means.

In the apparatus there can be at least two pincers which grip the top end of the cuff of the bag around the opening of the bag and draw the cuff of the bag together into a closed neck.

In the apparatus the bag gripping means can be a pair of opposing endless track mechanisms which grips the bag on either side as it advances downstream by means of the conveying means. The acceptor means may be a plow means which has a slot therein extending parallel with the direction of the conveyor means, and serves to embrace the neck of the bag. The fastening means may be a tape fastener which encircles the neck of the bag with pressure sensitive adhesive tape. Neck tucking means may serve to tuck the adhesively secured neck of the bag into the box after the neck of the bag has been sealed.

In the apparatus, four air jets aimed at the four upper corners of the box can be used to uncuff the bag and blow the upper edges of the bag into four matching pincers located approximately above the four air jets. The four pincers can be mounted on a carriage which is located above the four air jets, when the carriage is at an upstream position in the apparatus, and the carriage in unison with the conveying means, conveys the bag and box downstream towards the endless track gripping means. The carriage can have an X-shaped configuration. The gripping means can grip the upper regions of the uncuffed bag at four locations proximate the ends of the X-shaped carriage and draw the four gripped portions of the bag together in a direction corresponding with the arms of the X-shaped carriage towards the center.

In the apparatus, the tucking means may be a tucker bar located at the downstream end of the sealing apparatus, the tucker bar descending downwardly when the bag and box is positioned thereunder to cause the sealed neck of the bag to be forced between the bag and a wall of the box in which the bag is positioned.

The plow acceptor means can be in the form of a pair of parallel skis with the curved tips facing upwardly and upstream, the two skis forming a slot therebetween in which the gathered neck of the bag travels as the bag and box proceed downstream in the apparatus. The accumulating and compression means can be located on the plow means and cause the neck of the bag to be compressed prior to securing by the tape mechanism. The pair of ski-like plow means can cause a leading upwardly extending flap on the box to be forced rearwardly to a horizontal position, and the trailing flap on the box to be forced rearwardly to a horizontal position, as the box and bag proceed along the conveyor mechanism.

Bag position sensing means may be located along at least one position along the bag sealing apparatus. The leading flap of the box can serve to accumulate and compress the leading edge of the neck of the bag, while the accumulator means can move to compress the trailing edge of the bag against the edge of the leading flap.

The invention is also directed to an apparatus for encircling a pressure sensitive adhesive tape about the circumference of an article comprising: (a) resilient wheel means which carries a pressure sensitive adhesive tape along at least a portion of its surface, the adhesive side of the tape facing to the exterior of the resilient wheel means; and (b) a resilient spring means positioned on the side of the tape opposite the resilient wheel means, the resilient wheel means applying a force against the resilient spring means, the combination of the resilient wheel means carrying the pressure sensitive tape and the resilient spring means causing the adhesive side of the tape to grip and encircle an object as it is passed between the resilient wheel means and the resilient spring means.

In the apparatus, the resilient wheel means can be urged in the direction of the resilient spring means by a biasing means. Accumulator means can compress the object before it passes between the resilient wheel means and the resilient spring means. The apparatus can have tape cutting means to cut the tape from a tape supply means after the circumference of the object has been taped by the tape means.

DRAWINGS

In drawings which illustrate a detailed embodiment of the invention, but which are not to be regarded as restricting the spirit or scope of the invention in any way:

Figure 5A:
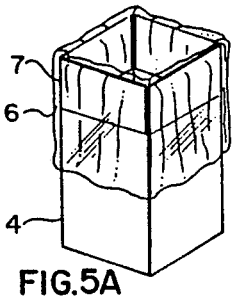
Figure 5B:
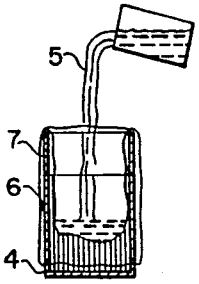
Figure 5C:
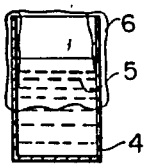

FIGS. 5*a*, 5*b*, and 5*c* illustrate in perspective and side elevation views the manner in which the cuff of a bag can become snagged on the corners of the flaps of a box when a liquid or particulate product is poured into the bag in the box.

Figure 6:
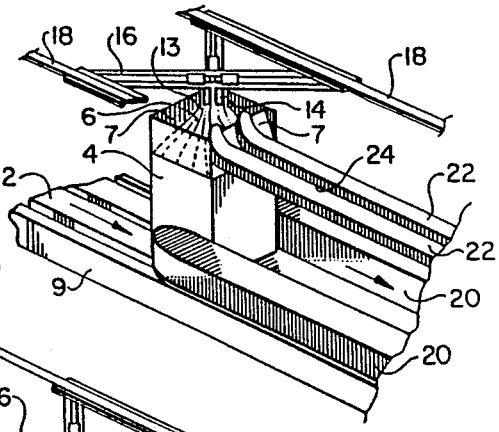

FIG. 6 illustrates a perspective view of the midstream position of the bag sealing machine illustrating the box at the position where it enters the side belt drives.

Figure 7:
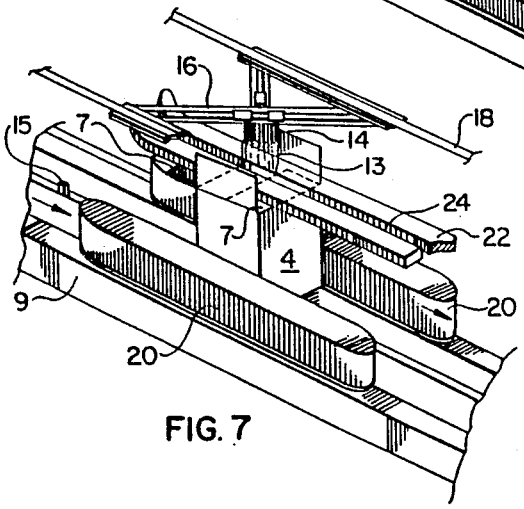

FIG. 7 illustrates a perspective view of the downstream end of the bag sealing machine illustrating how the drawn bag neck is positioned in the slot between the pair of overhead flap plows.

Figure 8A:
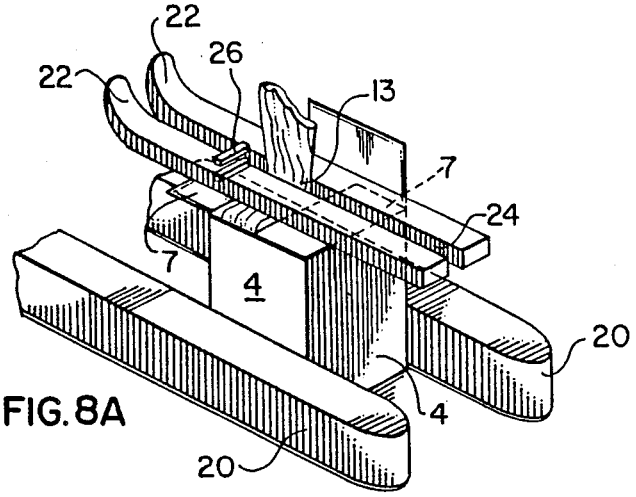

FIG. 8*a* illustrates a perspective view of the downstream end of the bag sealing machine with the neck of the bag ready to be gathered and compressed by a pair of accumulator claws.

Figure 8B:
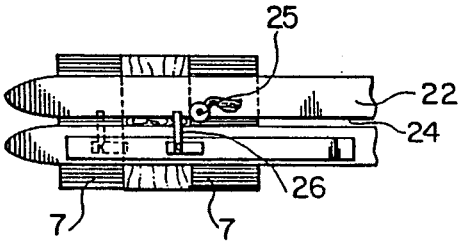

FIG. 8*b* illustrates a top view of the downstream end of the bag sealing machine illustrating the bag neck taping means and the movement of the accumulator claws.

Figure 9:
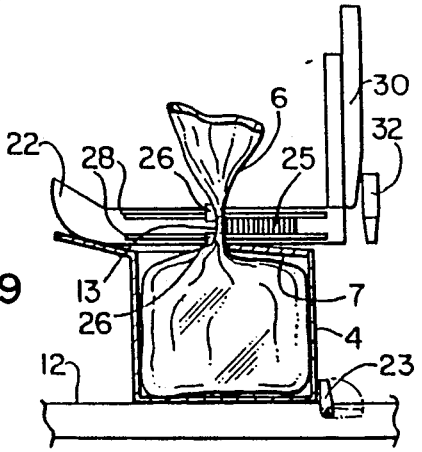

FIG. 9 illustrates a side elevation view of the downstream end of the bag sealing machine illustrating the mechanism whereby the accumulator claws gather the bag neck before the neck enters the tape mechanism.

Figure 10:
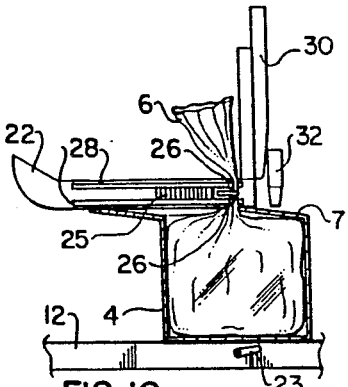

FIG. 10 illustrates a side elevation view of the downstream end of the bag sealing machine illustrating the manner in which the tape mechanism applies tape to the accumulated compressed neck of the bag.

Figure 11:
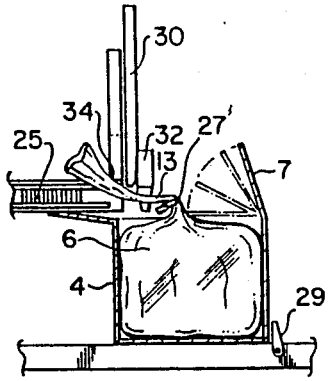

FIG. 11 illustrates a side elevation view of the downstream end of the bag sealing machine illustrating the accumulated bag neck and tucker bar.

Figure 12:
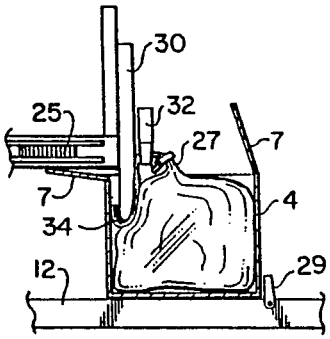

FIG. 12 illustrates a side elevation view of the downstream end of the bag sealing machine illustrating the manner in which the tucker bar tucks the bag neck into the box.

FIGS. 13, 14, 15, 16, 17, 18, 19, and 20 illustrate sequential top views of the method whereby the tape mechanism applies tape around the circumference of the gathered neck of a bag as it passes through the tape mechanism.

Figure 21A:
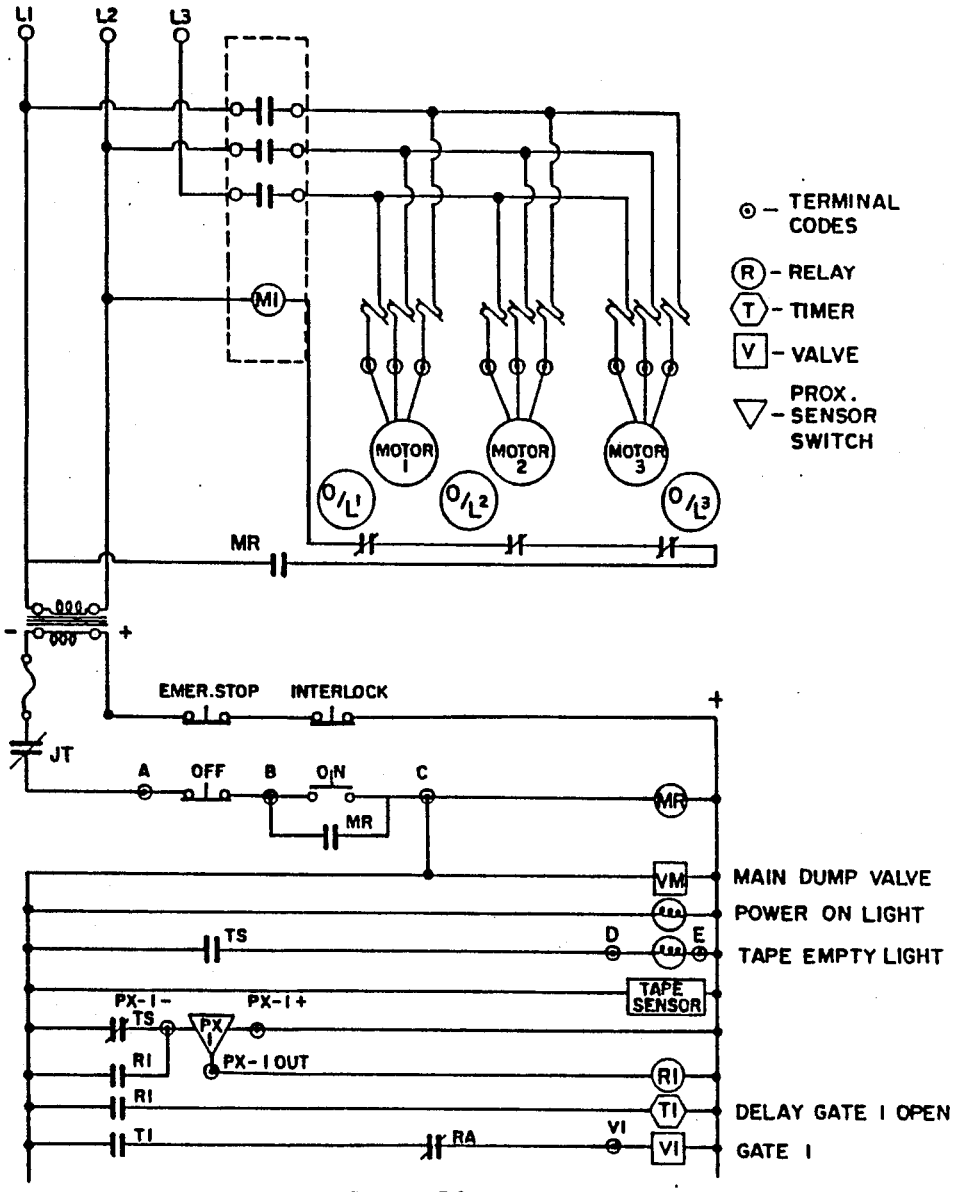
Figure 21C:
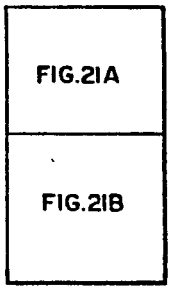
Figure 21B:
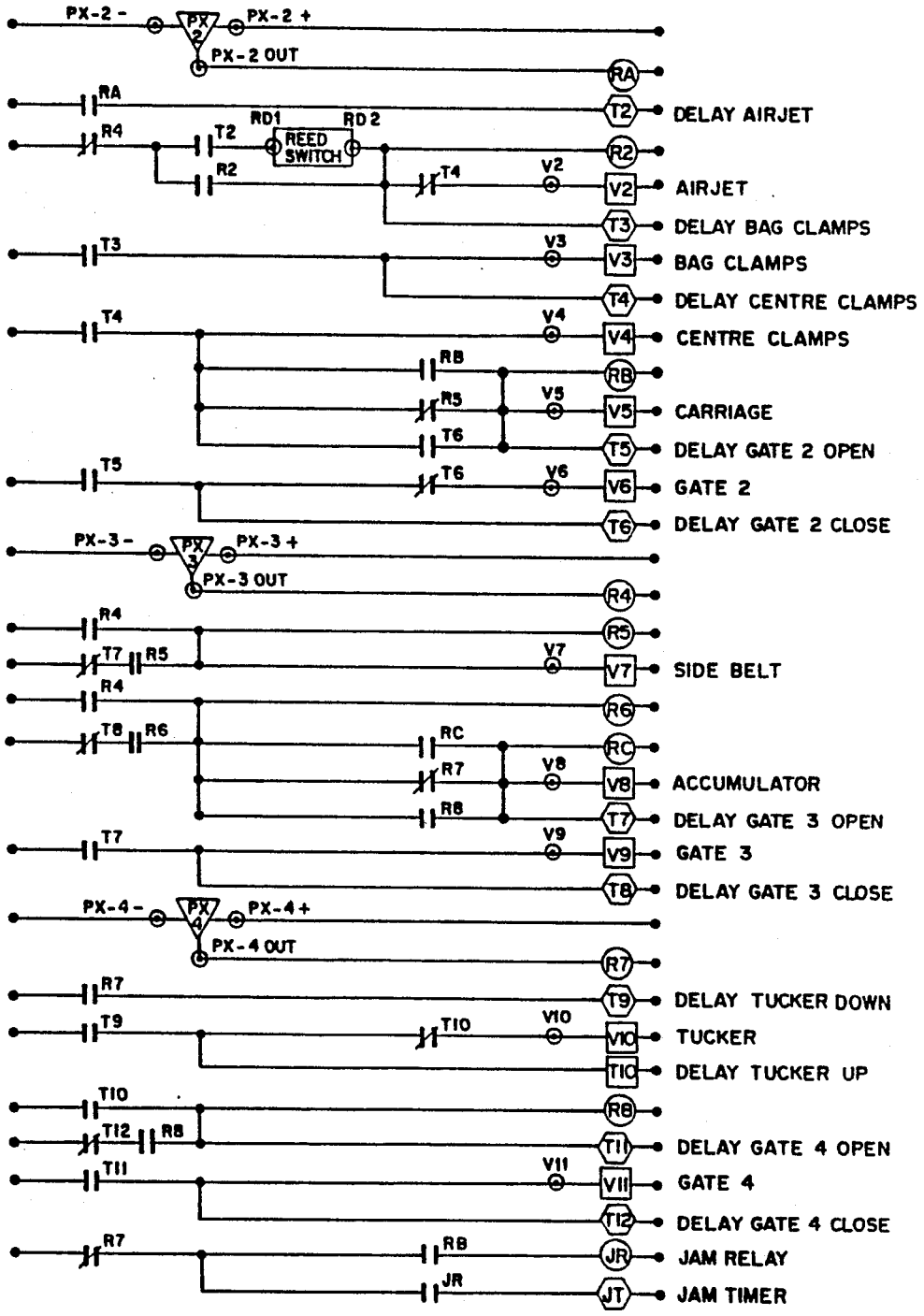

FIG. 21A, 21B, and 21C depict schematic wiring diagrams for the electronic components of the bag sealing machine.

DETAILED DESCRIPTION OF A SPECIFIC EMBODIMENT OF THE INVENTION

Figure 1:
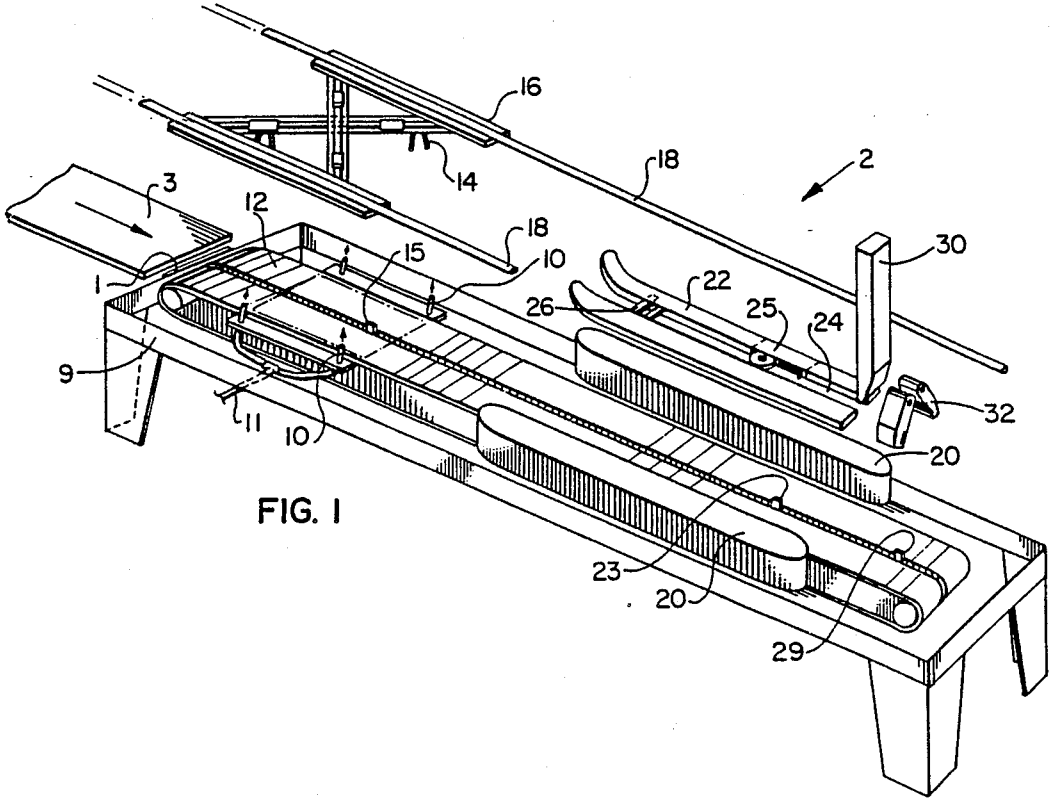
FIG. 1 illustrates a perspective view of basic components of the bag sealing machine.

Referring to FIG. 1 which illustrates a perspective view of the overall bag sealing machine 2, it can be seen that the machine is constructed basically of an initial stop gate 1, a pair of conveyor belts 12, four air jet nozzles 10, supplied with air through compressed air lines 11, a basic support frame 9, and an overhead clamp 14 (gripper) carriage 16 which travels along assembly track 18. The upstream end of the machine 2 is aligned with a separate box entry track 3. Downstream, there is a pair of endless belt box drives 20, an overhead box flap plow 22 with a slot 24 therebetween, a tucker bar 30 and a pair of pincers 32, the latter two components being indicated by dotted lines. Station stop gates 15, 23 and 29 are also depicted.

Figure 2:
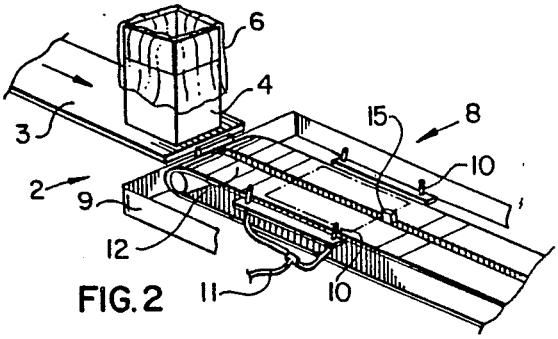
FIG. 2 illustrates a perspective view of the upstream portion of the bag sealing machine with a cuffed bag in a box ready for entrance at the upstream end of the bag sealing machine.

Referring to FIG. 2, a box 4 lined with a plastic bag 6 the upper end portion of which is everted and cuffed over the top flaps of the box 4 is filled with product (not shown) while the box 4 sits on track 3. The filled box and bag is then indexed into the uncuffing station 8 of the overall bag sealing machine 2. The uncuffing station 8 and other components of the overall apparatus are supported by a frame 9.

Figure 3:
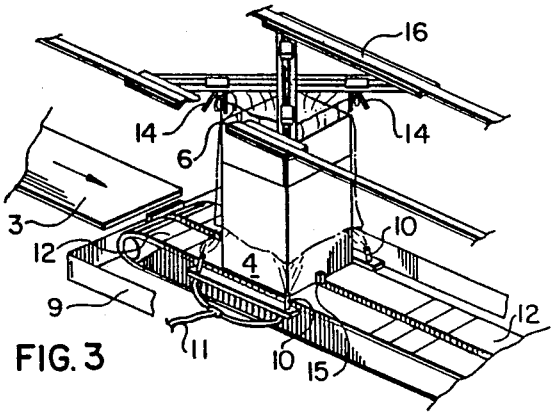
FIG. 3 illustrates a perspective view of the upstream end of the bag sealing machine illustrating the manner in which the bag is uncuffed from the box by air jets and the upper edges of the cuff gripped in four clamping fingers.

The uncuffing station 8 has four air jet nozzles 10 that are positioned at each of the four bottom corners of the station 8. These four jet nozzles 10 are supplied with controlled air pressure through lines 11 and respectively point vertically towards the top four corners of the box 4 when it is carried forward by the conveyor belts 12 to the station 8 (see dotted rectangle denoting the location of the base of the box at the station). Positioned above the four corners of the box 4 as seen in FIG. 3, are four pincer type clamps 14 which are initially in the open position. The clamps 14 close tightly after the airjet nozzles 10 have blown the four corners of the cuffed portion of the plastic bag 6 vertically into the respective four open clamps 14. (See FIG. 3). The four clamps 14 are mounted on a diagonal X-shaped frame 16.

Figure 4:
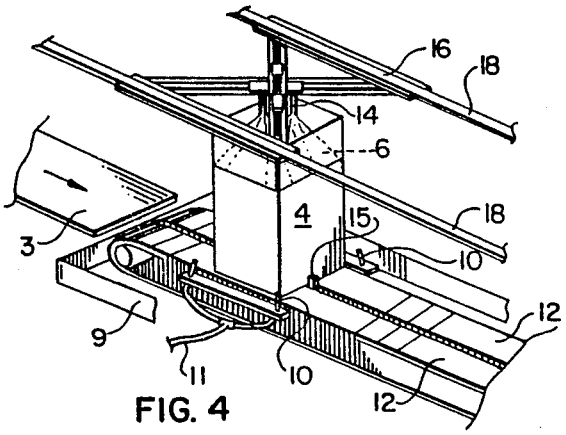
FIG. 4 illustrates a perspective view of the upstream end of the bag sealing machine illustrating how the upper region of the uncuffed bag is drawn together into a neck by means of the four pincers.

As seen in FIG. 4, the four clamps 14 are then drawn diagonally inwardly along the arms of the frame 16 by respective air cylinder pistons (not shown) where they meet together over the center of the box 4 to taper the upwardly extending upper end portion of the bag with the taper upwardly convergent. There are two important reasons why clamps 14 are used as part of the machine 2 and positioned as mentioned above: first, the four clamps 14 gather the top portions of the bag 6 together in order to position the neck of the bag for entry into the bag sealing mechanism (which is discussed below). Secondly the clamps 14, by their grabbing action ensure that the bag plastic has been removed (unsnagged) from the top four corners of the box 4 where snagging frequently occurs at the time of bag insertion, or filling of the bag.

FIGS. 5*a*, 5*b* and 5*c* illustrate by perspective and side section views how the bag 6 can become snagged on any one of the eight edges of the four upright flaps 7 when a load 5 is poured into the bag 6 positioned in the box 4. The load tends to draw the walls of the bag 6 downwardly, which promotes snagging of the plastic on the corners of the flaps 7.

Referring again to the bag sealing machine 2, and FIG. 6, once the top of the bag 6 is gathered together over the center of the box 4 to form a neck 13, the carriage assembly diagonal frame) 16 which supports and carries the four overhead clamps 14, then travels along a pair of horizontal parallel assembly tracks 18 at the same rate of speed as the underlying conveyor 12 which supports and conveys the loaded bag in the box 4.

As the conveyor 12 and carriage 16 travel downstream they together introduce the box 4 into a pair of side friction belt drives 20 which support and prevent the loaded box 4 from falling over backwards or to either side when the forward and rear vertical box flaps 7 are knocked down to a horizontal position by the compound plow 22 (see FIG. 6).

The compound curved plow 22 not only serves the purpose of knocking down the leading and trailing box flaps 7, but it also functions as guide means which corrals the neck 13 of the gathered bag plastic 6 into a long straight horizontal slot 24 which is located between the two longitudinal guides which form the compound plow 22 (see FIG. 7), and extend parallel to the direction of travel of the belts 12 and tracks 18, thus transversely compacting the upper end portion of the bag.

The leading flap 7 is knocked down to a horizontal position for two important reasons. First, the top edge of the knocked down flap 7 shortens or confines the leading side of the vertical accumulation of bag plastic 6 into neck 13 (within the horizontal slot 24) from the full length and width of the box to only half its length. This proportionately reduces the stroke length required to accumulate the neck 13 of the bag plastic 6 and results in a faster acting less costly gathering action. (FIG. 8*a* illustrates this feature in detail.) Secondly, the top edge of the horizontal flap 7 when it is flattened acts as a support edge when the bag plastic 6 has been accumulated against it. When the leading flap 7 has been knocked down to a horizontal position the edge is positioned over the center of the box 4. This ensures that the neck 13 is correctly placed in a central position and not off to one side of the box 4. (See again FIG. 8*a*).

The overhead carriage 16 and bottom conveyor 12 together with the pair of sidebelt drives 20 continue to transport the box 4 and its internal bag 6 with the drawn neck 13 to a stop gate 23 (not shown in FIG. 8*a*) which, when adjusted to the particular box size, will position the center of the box under the starting position of the taping mechanism 25. (See top view in FIG. 8*b*). At this point, the carriage 16 and its clamping members 14 release the bag neck 13 and they return upstream along the tracks 18 to their home position over the uncuffing station 8. (See FIG. 3) At the instant the box 4 is in position, the sidebelt drives 20, which have gripped and pulled the box 4 to this position, retract and thereby release their driving force against the box 4 momentarily so as to allow enough time for a bag gathering device comprising a pair of accumulator claws or pushers 26 to accumulate and compress the vertical bag neck 13 into a column against the edge of the leading flap 7. (See FIGS. 8*a* and 8*b*.) As seen by means of dotted lines in FIG. 8*b*, the accumulator claws 26 move from an upstream retracted rest position (the dotted lines show the accumulator claws after they have advanced laterally from a retracted position) downstream towards the leading flap 7 where they are controlled to stall out at the position shown by the solid lines against the bag accumulation apparatus. The bottom conveyor 12 runs continuously and is constructed of a slip friction material which enables it to easily and continuously slide under the momentarily stopped box 4, when the box is held or stalled for any reason.

Once the accumulator claws 26 have gathered up the vertical neck 13 of the bag and have compressed it into a tight column against the box flap edge 7, they enter the tape mechanism 25 (see side view in FIG. 9). The gate 23 releases and the box 4 starts to move downstream. The two claws 26 of the accumulator device which extend across the horizontal slot 24 (one positioned to pass over the taping mechanism 25 and the other to pass under it) follows the neck 13 of plastic 6 along upper and lower tracks 28 through and past the taping mechanism 25 thereby keeping the neck in a compressed state. (See FIGS. 9 and 10.)

As the box 4 advances along the belt 12, through the taping mechanism 25 to the next stop gate position 29 the neck 13 of bag plastic 6 which has been taped by the taping mechanism 25 with tape 27 is knocked down to a horizontal position by means of the tucker bar 30 (see FIG. 11 which shows the tucker bar 30 in an upper position). The tucking action occurs as follows. When the box 4 has come to a stop at gate 29, a clamp-like pincer 32 located behind and downstream of the tucker bar 30 clamps the neck of the bag 6 (just above the tape 27) as it exits the downstream end of the slot 24 of the plow 22 (see FIG. 11).

Once the neck of the bag is secure in the pincer 32, the tucker bar 30 starts its downward stroke (see arrows in FIG. 12) thereby tucking the tail end 34 of the bag 6 down in between the inside of the rear side of the box 4 and the bag 6 holding the product. The tucker 30 then retracts to its upper position and the clamp-like pincer 32 releases the tail 34 of the bag. The stop gate 29 then retracts and the box 4 exits the machine 2.

There are two important reasons why the bag neck 13 is clamped by the pincers 32 prior to tucking in the tail 34 of the bag. First, clamping isolates the tape closure 27 from the forces and stresses involved when the tucker bar 30 pushes the tail 34 of the bag down into the box 4. Secondly, in relation to the tucker bar 30, and because the tail 34 slides on both sides of the tucker bar 30 when the neck 13 is held, and the bag tail 34 is tucked downwardly in the box 4 in a folded manner, the tucker bar 30 only needs to travel downwardly one-half stroke (length) relative to the overall length of the neck 13.

The tucker bar 30 is located at the end of the gathering and taping slot 24 because at that point, the bag tail 34 is still in a tight compressed accumulation and the thickness of the neck 13 acts as a strong unitary member so as to prevent the tucker bar 30 from piercing the bag 4 and its contents.

As can be seen in FIG. 11 and 12, at the tucker station, the trailing flap 7 has been folded back to a horizontal position at right angles to the vertical back side of the box 4. This reinforces the top of the rear vertical edge of the box 4. The tucker concept relies on this reinforced configuration to rigidize the vertical rear side of the box 4 and thereby prevent it from creasing or bending as the tucker bar 30 decends downwardly into a non-compressible product content. (See FIG. 12.)

The apparatus and method used for taping the gathered neck of the bag is illustrated in sequential fashion in FIGS. 13 through 20 inclusive. FIGS. 13 to 20 are top views which illustrate how the plastic neck of the bag is compressed by means of the accumulator claws or pushers, passes through the spring loaded tape application wheel and lastly through a blade actuating arm which cuts the tape closure from the supply of tape to the application wheel.

The eight sequential top view figures depicted in FIGS. 13 to 20 demonstrate in detail the mechanism and method of taping the neck of the bag. The location of the taping mechanism 25 within the overall bag sealing machine is illustrated in FIG. 8*b*.

Figure 13:
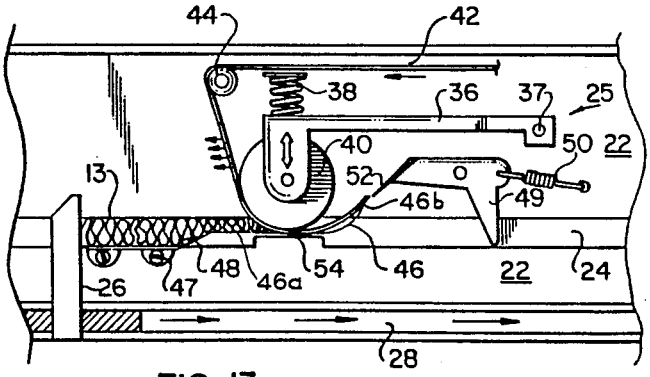

As can be seen in FIG. 13, a taping mechanism 25 is constructed of a number of components. A spring loaded arm 36 pivots laterally about pivot point 37. Pressure is applied against spring loaded arm 36 by means of a coil spring 38. Applicator wheel 40 is mounted on spring loaded arm 36 and along with spring loaded arm 36 moves laterally to the direction of the slot 24 which exists between the two plows 22 which form the compound plow or guide means discussed previously. Accumulator claws 26 travel towards the applicator wheel 40 along accumulator track 28. A pressure sensitive adhesive tape 42, with the adhesive surface facing outwardly relative to applicator wheel 40, runs around tape idler roller 44, and then around applicator wheel 40. As it runs around wheel 40, the tape 42 travels in the same direction as accumulator claws 26 and the bag neck 13, that is, in a downstream direction. Applicator wheel 40 squeezes tape 42 against a curved spring formed of spring steel 46. The force applied by spring 38 (the biasing means) on spring loaded arm 36, and thus through wheel 40 on spring 46 bears against pressure surface or back-up 54. Spring 46 is secured adjacent one end to plow 22 at one side of slot 24 by means of mounting screws 47. A compression bend 48 is fashioned in spring 46 and constitutes a first portion of the spring angled toward the other side of the slot serving the purpose of compressing the width of plastic bag neck 13 as it advances downstream and ultimately between applicator wheel 40 and spring 46. The spring 46 is also formed to have a generally straight second portion **46*a* extending downstream from portion 48 generally in a vertical plane between the planes of the sides of the slot, and a third portion 46*b*** extending downstream from said second portion constituting a free end portion of the spring curved to extend over the other side of the slot.

A pivot arm 49, the movement of which is controlled by pivot arm spring 50, carries a cutting blade or knife 52. Pivot arm 49 and blade 52 are located immediately downstream of the downstream end of spring 46.

Figure 14:
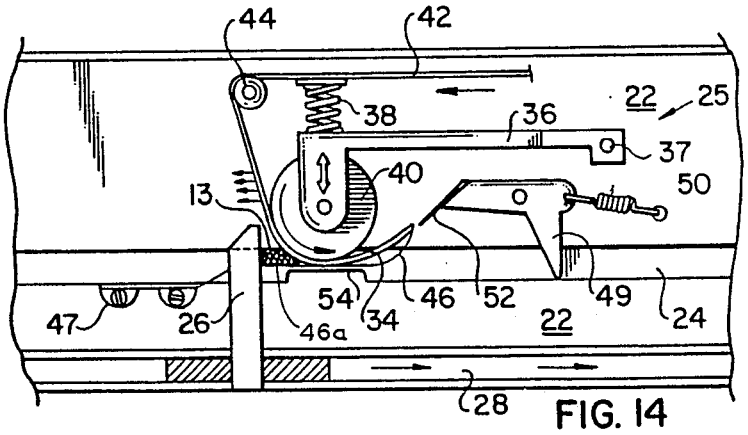

The taping procedure proceeds as follows. As seen in FIG. 13, the plastic bag neck 13, by means of accumulator claws or pushers 26, is pushed downstream and compressed to approximately ½ its thickness by means of compression bend 48. FIG. 14 illustrates the position of the accumulator claws 26, and the tightly compressed orientation of plastic bag neck 13 immediately before the neck 13 is forced between tape 42 and spring 46, which is supported by pressure surface 54.

Figure 15:
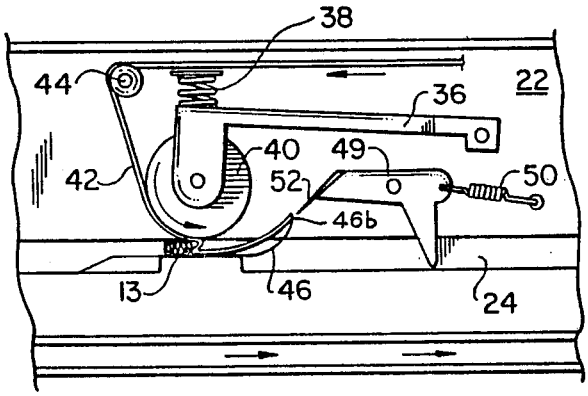

As can be seen in FIG. 15, which shows the neck 13 as it is being forced between applicator wheel 40 and portion **46*a* of spring 46, the bag neck 13 is very tightly compressed. Wheel 40 is forced away from spring 46 and pressure surface 54 and compresses spring 38. The neck accumulation 13, as it advances, and because the pressure sensitive adhesive is on the side of the tape 42 facing the neck 13, causes the tape 42 to curl about the leading edge of the neck 13. The amount of tape 42 required in order to make a complete tape closure about the neck 13** is represented by the distance between A and D. The section of tape from A to B forms one half of the tape closure, while the section of tape C to D forms the other half of the tape closure.

Figure 16:
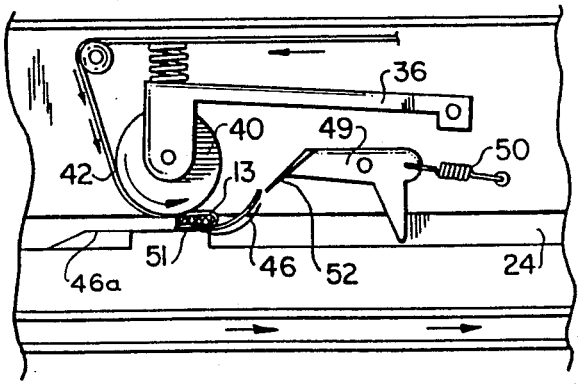

As seen in FIG. 16, the neck accumulation 13 has advanced downstream to the point where the tape 42 has almost entirely encircled the neck 13, and includes an overlapping tape section between accumulation 13 and spring 46 as indicated by the lead line 51. As the neck accumulation 13 advances downstream, it continues to draw off more tape from the supply as well as peeling more tape off the spring 46.

Figure 17:
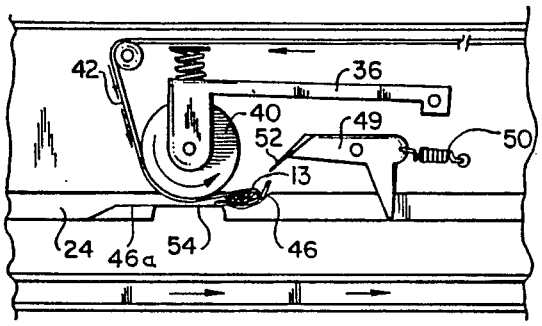
Figure 18:
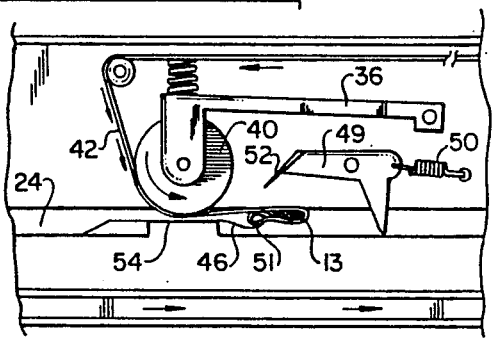

The neck accumulation 13 continues to advance until it reaches the position shown in FIG. 17. As seen in FIG. 17, the two adhesive surfaces begin to make contact with one another at the upstream end of the neck accumulation 13, while the neck accumulation 13 undergoes even more compression when it is in contact with the hook end of the spring 46. The tightly compressed accumulation 13 continues to advance downstream in slot 24 as seen in FIG. 18. By this time, applicator wheel 40 has almost returned to a position where it rests against spring 46. Meanwhile, the two facing adhesive surfaces have become adhesively secured to one another and a loop has formed in tape overlap 51. As seen in FIG. 18, as the accumulation 13 continues past the hook end of the spring steel, the hook end of the spring 46 snaps back to its original position and closes the two adhesive surfaces of the tape together.

Figure 19:
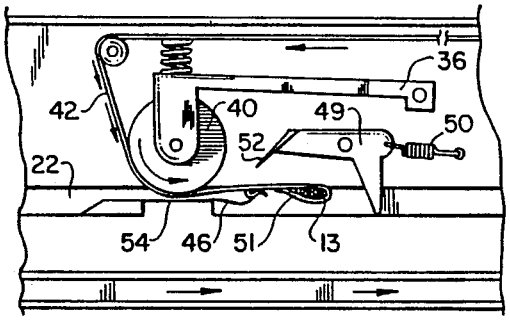

FIG. 19 illustrates the accumulation 13 as it has advanced further downstream from the position illustrated in FIG. 18 as previously discussed. At this point, the accumulation 13 has been completely encircled with tape 42, and the loop 51 has been been almost completely enclosed by the hook end of spring 46 as it returns to a closed position. The hook end of the spring 46 presses the adhesive tape together so that the two faces are secured together over a significant length of tape. This ensures that a secure tape closure has been made.

Figure 20:
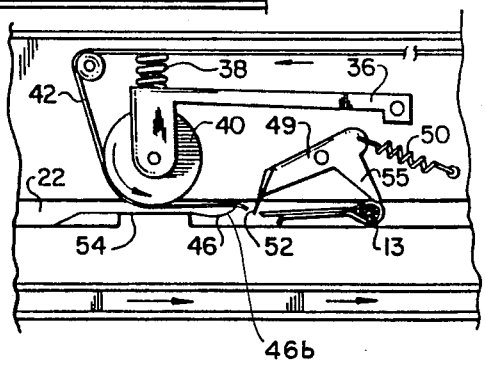

Finally, as seen in FIG. 20, the neck accumulation 13 advances downstream along slot 24 to the point where it moves actuating arm 55 of pivot arm 49. This causes blade 52 to be forced across slot 24, thereby severing the tape 42. Once the accumulation 13 passes by actuating arm 55, pivot arm spring 50 compresses and causes pivot arm 49 to return to its original position as shown in FIG. 13. As will be noted, blade 52 cuts the tape 42 at a point where it leaves enough tape 42 to entirely cover spring 46, as seen in FIG. 13. After the taped neck accumulation 13 has been entirely taped, as illustrated in FIG. 20, the spring loaded arm 36 by means of spring 38 returns to a position where wheel 40 squeezes tape 42 against spring 46 and pressure surface 54, ready to tape the neck of the next bag on the line.

This taping system can accommodate different types and sizes of bags, without changing any parts in the taping mechanism. The taping mechanism 25 is used in conjunction with a powered accumulator which consists of a cylinder which powers two accumulator claws 26 which extend across a slot 24 in which the bag neck 13 is located. These claws 26 gather (accumulate) the top portion of the bag into a vertical column (neck 13) and pull it through the taping mechanism 25.

An important point to note is that the spring loaded tape applicator wheel 40 within the taping mechanism is constructed of a resilient material such as a polymeric foam to provide resilient pressure against the tape rear face and ensure that the tape 42 will adhere to the spring steel 46.

The taping mechanism 25 is versatile in that it can be used without a powered bag gathering device such as the accumulator. For example, gathered material could simply be pulled through the mechanism by hand. However, a powered accumulator is preferred for consistent trouble-free operation.

FIG. 21 depicts a schematic wiring diagram for the electronic components of the bag saling machine. Three motors are used to drive the machine. The system includes controls for the first delay gate 1, the air jets and the bag clamps for the uncuffing station 8, controls for the carriage 16 and second delay gate 15, controls for the side belts 20, controls for the accumulator claws 26 and third delay gate 23, controls for the tucker bar 30, and controls for the fourth gate 29. The legend at the upper left side of the diagram identifies the electronic and mechanical components of the system.

A typical bag and box sealing run proceeds as follows. A box 4 stops at gate 1 and turns on (switch 1). (Switch 1) starts timer 1. 0.75 seconds later, gate 1 retracts and lets box 4 proceed to the second gate 15 and turn on (switch 2). (Switch 2 starts timer 2. 0.2 seconds later, the air jets 10 upright or uncuff the bag 6 into the gripper clamps 14 and timer 3 starts. 0.2 seconds later, the gripper clamps 14 close tight on the upper edges of the bag 6 and timer 4 starts. 0.2 seconds later, the air jets 10 shut off, the grippers 6 center to locate over the box, the carriage 16 starts to move downline and timer 5 starts.

0.2 seconds later, gate 15 retracts and allows the box 4 to proceed downstream into the sidebelts 20. When the carriage 16 (following over the box 4) completes its travel, it turns on (switch 3). (Switch 3) indexes the sidebelts 20 away from the box 4, cancels out a holding circuit to return the carriage 6 to its upstream position, releases the gripper clamps 14 from the bag 6 and returns them to their outer positions, and then starts accumulator 26 to gather the bag neck 13 and starts timer 7.

0.2 seconds later, gate 23 retracts and the sidebelts 20 index their driving force back against the box 4. The box 4 then proceeds to the fourth gate 29 where it turns on (switch 4). (Switch 4) starts timer 9. 0.2 seconds later, the tucker bar 30 extends, and timer 10 starts. 0.2 seconds later, the tucker bar 30 retracts and timer 11 starts. 0.2 seconds later, gate 29 retracts and lets the box 4 proceed and start timer 12. 0.5 seconds later, gate 29 closes. Timers 6 and 8, which are not mentioned above, are to delay the closing of gates 15 and 23 respectively after the box 4 has cleared the gates.

EXAMPLE

A prototype of the bag sealing machine has been constructed and performance tested. The prototype has performed extremely well under a variety of conditions. The prototype has been designed to satisfy the following specifications. It should be understood that the specifications for the prototype may not necessarily be adopted for actual production machines, which would be designed to suit variable production criteria.

1. Environmental Conditions (a) Temperature: Operating range is from below freezing temperatures to 120 degrees F. Considerations to adhesive types on tape backing is required when operating close to each end of range. Dry air must be used in below freezing temperatures to avoid freezing of accumulated condensation in air components.

(b) Humidity: High and low humidity do not hinder performance.

(c) Accumulation of Foreign Matter: The accumulation of dust, dirt or product on or in the machine will not affect the performance of the machine unless the viewing sights of the electronic sensors (which detect box and function movements) are blocked. Also, airline filters and components must be clear of contaminants.

2. Misadjustments of Machinery (a) Width Adjustment: Up to ¾" wider than the optimum setting, down to ¼" narrower than the optimum setting.

(b) Length Adjustment: Up to ¾" longer than the optimum setting, down to 1" shorter than the optimum setting.

(c) Height Adjustment: (open Box, flaps upright): Up to 1¼" higher than the optimum setting, down to ¼" lower than the optimum setting.

(d) Height Adjustment (closed box, flaps folded): Up to 2" higher than the optimum setting, down to ½" lower than the optimum setting.

(e) Bag Gripper Adjustment: Up to ⅝" wider than the optimum setting, down to ¾" narrower than the optimum setting.

(f) Tape Tensioner Adjustment: Dependent on the type of tape used.

(g) Air Pressure Adjustment: Air pressure up to 120 p.s.i., down to 75 p.s.i. Optimum air pressure is 90 p.s.i.

3. Product Content Variations (a) Powders, liquids and solids can all be processed. Also potentially difficult product such as bulk stuck-together candy can be readily processed.

(b) Product overfill is handled up to 1" over the closed height of the box.

(c) Product underfill can be handled to as low as 4" below the closed height of the box. A box with a lower than 4" underfill can be processed by modifying the stroke length of the tucker bar.

(d) Weight of the product content is limited to 100 lbs. per box, but minor modification can increase this limitation. The minimum content weight that the machine can process without modification is 2–3 lbs.

4. Box Variations

The machine has been designed and engineered to handle the following variations:

(a) Strong and rigid boxes made from two layers of laminated corrugation (conventionally called double wall).

(b) Difficult to bend flaps due to poor score lines where flaps are to hinge.

(c) Waxed boxes which at times can be slick or slippery.

(d) Poor quality boxes made from recycled paper where the corrugations can tear, bend and wrinkle easily.

(e) Dry, crisp boxes as well as damp, soft, poor structural strength boxes.

(f) Labelled and printed boxes (all colours) which can sometimes fool electronic sensing systems.

(g) Size range capability is from 7" cube to 14" cube (closed box size) and any variations in between. However, in the unlikely event a box comprising the two extremes such as 7"×7"×14" high are encountered, options and modifications can be incorporated to prevent such a tall and narrow box from tipping over.

5. Bag Variations

The machine has been designed and engineered to handle the following variations.

(a) Size Range: From 1" larger than the perimeter of the box used to 6" larger than the box perimeter. The length or height of the bag when upright must not exceed more than 12" above the height of the open top flaps of the box being used. Minimum 3" above.

(b) Plastic Types: Polyethylene and polypropylene.

(c) Density: Bags used must be of the low to medium density group.

(d) Gauge Thickness of Plastic: Bag gauge must not be less than 1 ml. in thickness and no greater than 5 ml. when using 3 ml. thickness bags or greater, they must be of the low density group only.

6. Tape Variations (a) Tape Backing or Carrier: Creped paper, polyester, vinyl, polypropylene, cellophane.

(b) Thickness: 1 ml. to 5 ml. up to 10 ml. for paper back tape.

(c) Adhesives: Rubber or acrylic.

(d) Tensile Strength: 20 lbs/in. to 200 lbs/in.

(e) Adhesive Power: Minimum 20 oz/in., maximum 50 oz/in. check release coating for ease of unwinding.

(f) Elongation: 0.0 to 50%.

(g) Sizes:

(i) Width from ⅜" wide to ⅝" wide. One guidance part must be exchanged.

(ii) Length, because of variations on tape thickness, standard equipment will house up to 5" outside diameter, rolls, core diameter is 3 in. Other options include 6 mile long tape capacity and date coding (h) Tape Yield: Length of tape applied to each closure can be adjusted from 3½ to 5½ in.

7. Specifications (a) Conveyor Speeds: 90 to 150 ft/min.

(b) Air Consumption: Approximately 1.1 cu.ft/cycle.

(c) Weight: Approximately 780 lbs.

(d) Speed: Up to 35 closures/min.

(e) Dimensions: Approximately 72" long, 60" high and 36" wide.

(f) Speed of Adjustments: 3 minutes total.

(g) Failure Rate: Approximately (0.00002) (1 in 50,000 cycles).

(h) Construction materials: Non-corrosive plated steels, aluminum and suitable plastics.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

I claim:

1. Bag tying apparatus comprising means for conveying filled bags one after another in a generally horizontal generally linear path with the mouth end of each bag extending upwardly and gathered for being tied with tape having a pressure-sensitive adhesive on one face thereof, guide means extending above the conveyor means defining a generally straight guide slot for guiding the upwardly extending gathered mouth of each successive bag, the gathered mouth travelling in downstream direction in the slot, a leaf spring secured adjacent one end thereof to said guide means at one side of said slot extending in downstream direction from its said one end and having a first portion angled toward the other side of the slot for laterally compressing the bag mouth as it travels downstream in the slot between said first portion and said other side of the slot, a second generally straight portion extending downstream from said first portion generally in a vertical plane between the planes of the sides of the slot, and a third portion extending downstream from said second portion constituting a free end portion of the leaf spring curved to extend over the other side of the slot, a wheel mounted on said guide means at said other side of the slot with its axis generally vertical and with the wheel movable in a generally horizontal plane toward and away from said second portion of said leaf spring, means biasing said wheel for movement in said generally horizontal plane in the direction toward said second portion of said leaf spring, for compressing the gathered bag mouth against said second portion of said leaf spring, a back-up for said second portion of said leaf spring on said one side of said slot, means for guiding a tape from a continuous supply thereof for travel around the wheel and thence in downstream direction from the wheel along said second and third portions of said leaf spring with the adhesive face of the tape facing outwardly away from the wheel, whereby on passage of a gathered bag mouth in downstream direction between the tape passing around the periphery of the wheel and said leaf spring the gathered bag mouth is further compressed and the tape is looped around the compressed gathered bag mouth, adhered thereto and has portions thereof in face-to-face relation and adhered together by the adhesive thereon, and a knife carried by the guide means movable generally in said horizontal plane away from a retracted position spaced from the slot across the slot adjacent the end of said free end portion of said leaf spring to cut the tape as the gathered bag mouth with the loop thereon passes by said free end portion of the leaf spring, said knife having means extending across the slot engageable by said gathered bag mouth with the loop thereon as the mouth travels downstream from said free end portion of the leaf spring to move the knife from its retracted position across the slot to cut the tape and allowing the tied bag mouth to pass on by for exit from said slot, said slot being open at its upstream end for entry therein of the mouth of each bag and open at its downstream end for exit therefrom of the tied bag mouth of each bag as the bag is conveyed downstream by said conveying means.

2. Bag tying apparatus as set forth in claim 1 further comprising means movable relative to the guide means engageable with the mouth of each bag as it travels in downstream direction in said slot for moving the mouth downstream in said slot and maintaining the mouth in a compressed state as it travels between said leaf spring and said wheel.

3. Bag tying apparatus as set forth in claim 2 wherein said means for moving the mouth downstream in said slot and maintaining it in a compressed state comprises an upper and a lower pusher passing above and below said plane.

* * * * *